US006067433A

United States Patent [19]

Kimura et al.

[11] Patent Number: 6,067,433

[45] Date of Patent: May 23, 2000

[54] DEVELOPING APPARATUS FOR REGULATING THE AMOUNT OF DEVELOPER IN THE VICINITY OF REPULSIVE MAGNETIC POLE

[75] Inventors: Shigeo Kimura, Mishima; Koji Masuda, Numazu; Takao Ogata, Susono; Kazuhiro Hasegawa, Numazu, all of Japan

[73] Assignee: Canon Kabushiki Kaisha, Tokyo, Japan

[21] Appl. No.: 09/110,019

[22] Filed: Jul. 2, 1998

[30] Foreign Application Priority Data

Jul. 4, 1997 [JP] Japan ..... 9-194845
Oct. 31, 1997 [JP] Japan ..... 9-316478

[51] Int. Cl.[7] ..... G03G 15/09

[52] U.S. Cl. ..... 399/274; 399/264; 399/275; 399/277

[58] Field of Search ..... 399/274, 275, 399/277, 269, 252, 264, 265, 267

[56] References Cited

U.S. PATENT DOCUMENTS

| | | | |
|---|---|---|---|
| 4,873,551 | 10/1989 | Tajima et al. | 399/270 |
| 4,982,689 | 1/1991 | Honda et al. | 399/270 |
| 5,253,018 | 10/1993 | Takeuchi et al. | 355/246 |
| 5,434,351 | 7/1995 | Iwai et al. | 399/276 |
| 5,469,244 | 11/1995 | Ogata et al. | 355/246 |
| 5,559,587 | 9/1996 | Ogata et al. | 355/246 |
| 5,606,404 | 2/1997 | Hilbert et al. | 399/267 |
| 5,697,010 | 12/1997 | Masuda et al. | 399/46 |

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

A developing apparatus includes a developer bearing member, a first magnetic pole and a second magnetic pole of a same polarity as that of the first magnetic pole, and a regulating member. A regulating portion of the regulating member is provided within a range from a point of the maximum magnetic flux density of the second magnetic pole and an angular point corresponding to a half of the half value width of the second magnetic pole at the downstream side in the rotating direction of the developer bearing member.

8 Claims, 9 Drawing Sheets

DEVELOPING APPARATUS FOR REGULATING THE AMOUNT OF DEVELOPER IN THE VICINITY OF REPULSIVE MAGNETIC POLE

BACKGROUND OF THE INVENTION

1. Field of the Invention

The present invention relates to a developing apparatus adapted for use in an image forming apparatus of electrophotographic or electrostatic recording method such as a copying apparatus or a printer and capable of developing an electrostatic image on an image bearing member.

2. Related Background Art

Conventionally a developing apparatus shown in FIG. 5 is commonly employed for magnetic brush development utilizing a two-component developer.

The developing apparatus 1 is provided with a developing container 2 in which two developer bearing screws 6*a*, 6*b* are provided in parallel. The two-component developer contained in the developing container 2 is circulated by the above-mentioned screws 6*a*, 6*b*. The developing apparatus 1 is further provided with a developer bearing member 10 for bearing the developer in the developing container 2 toward a developing portion opposed a photosensitive drum 100 constituting the image bearing member. The developer bearing member 10 is usually composed of a cylindrical developing sleeve, in which a magnetic field generating means 11 constituted by a magnet roller is provided in an unrotating manner with respect to the rotation of the developing sleeve 10.

The developer in the developing container 2 is scooped up onto the developing sleeve 10 by a pole N2 of the magnet roller 11, and is borne, by the rotation of the developing sleeve 10, through poles S2, N3 and S1. In the course of bearing, the developer is regulated in thickness by a regulating blade 30 constituting developer regulating means and provided in noncontacting manner to the developing sleeve 10 in the vicinity of the pole S2, whereby a thin layer of the developer is formed on the developing sleeve 10. The pole S1 of the magnet roller 11, positioned at the developing portion, constitutes a main developing pole, and the developer caused to stand in the form of a brush by the pole S1 develops a latent image formed on the photosensitive drum 100. Subsequently the developer is removed from the developing sleeve 10 by the repulsive magnetic field of the poles N1, N2 and drops, thereby being returned into the developing container 2.

In such a conventional developing apparatus 1, however, the developer regulated by the regulating blade 30 remains in a large amount by the magnetic force of the poles S2 and N2 at the upstream side of the blade 30 with respect to the rotating direction of the developing sleeve 10, and such developer is subjected to a large pressure because the developer is continuously borne by the developing sleeve 10. As a result, in the developer remaining in the vicinity of the regulating blade 30, a strong force is applied between the magnetic carrier and the resinous toner to result in a phenomenon of embedding, into the resinous toner, of fine particles such as $SiO_2$ and so on externally added to the toner particles. Also the shape of the resinous toner particles becomes rounder, by the elimination of sharp edges through collision with the magnetic carrier particles. Also after prolonged use, there results a so-called spent phenomenon that the resinous toner sticks firmly to the surface of the magnetic carrier and becomes unremovable.

With such a phenomenon, the amount of triboelectricity of the resinous toner varies with the time of use, thus leading to a variation in the image density or an increase in the mechanical sticking force of the resinous toner to the magnetic carrier or the photosensitive drum 100, eventually resulting in difficulty the image development or image transfer corresponding to the electric field and the local lack or unevenness of the toner. As a result, the image quality is extremely deteriorated in comparison with that in the initial stage.

FIG. 6 shows another example of the developing apparatus, in which, in order to prevent such remaining of the developer, the regulating blade 30 is positioned with an angle a, toward the downstream direction in the rotating direction of the developing sleeve 10 (counterclockwise in the drawing) from the tangential direction thereof, increased from 90° to a range 150° to 180°.

With such an arrangement of the regulating blade 30, the developer remaining after the regulating operation thereof advances along the regulating blade 30 and remains less in the upstream side, in the rotating direction of the developing blade 10, of the regulating blade 30. However, as the developer is continuously supplied by the developing sleeve 10 to the regulating blade 30, the superfluous developer gradually accumulates thereon and is pressurized. Consequently the developer deteriorates by the pressure after the prolonged use, and the deterioration of the developer cannot be improved significantly even by such configuration.

SUMMARY OF THE INVENTION

An object of the present invention is to provide a developing apparatus capable of preventing the deterioration of the developer, thus enabling the developing operation with a stable image density over a prolonged period.

Another object of the present invention is to provide a developing apparatus capable of reducing the pressure applied to the developer.

Still another object of the present invention is to provide a developing apparatus comprising:

- a developer bearing member forming a developing portion in an opposed relationship to an image bearing member and adapted to rotate while supporting the developer;
- a first magnetic pole and a second magnetic pole of a polarity same as that of the first magnetic pole, adjacent thereto at the downstream side thereof in the rotating direction of the developer bearing member, both magnetic poles being provided in the developer bearing member; and
- a regulating member for regulating the amount of the developer on the developer bearing member;
- wherein the regulating portion of the regulating member is provided within a range from the position of maximum magnetic flux density of the second magnetic pole to an angular position corresponding to a half of the half value width of the second magnetic pole at the downstream side in the rotating direction of the developer bearing member.

Still other objects of the present invention will become fully apparent from the following description.

DESCRIPTION OF THE PREFERRED EMBODIMENTS

In the following an image forming apparatus embodying the present invention will be explained with reference to the attached drawings. The following embodiments will be explained in the forms applicable to the electrophotographic image forming apparatus as shown in FIG. 4, but such forms are not restrictive.

Figure 4:
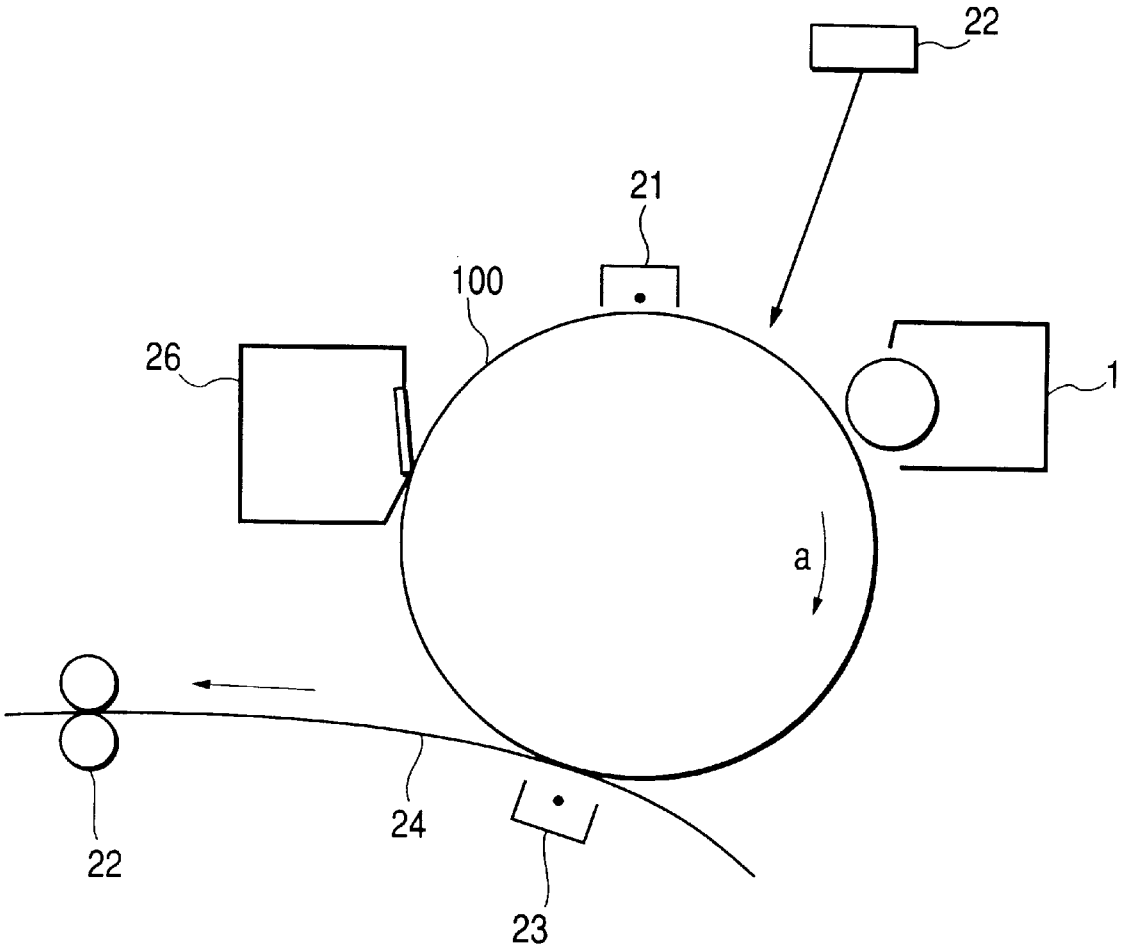
FIG. 4 is a schematic view showing an example of the electrophotographic image forming apparatus in which the present invention is applicable.

In the electrophotographic image forming apparatus shown in FIG. 4, a photosensitive drum 100 constituting the image bearing member and provided rotatably in a direction a is uniformly charged with a primary charger 21 and is subjected to the exposure of information signal by a light emitting element 22 such as a laser to form an electrostatic latent image, which is developed into a visible image by a developing apparatus. The visible image is transferred by a transfer charger 23 onto a recording sheet 24 and is fixed by a fixing device 25 to obtain a permanent image. The toner remaining on the photosensitive drum 100 is removed by a cleaning device 26.

[Embodiment 1]

Figure 1:
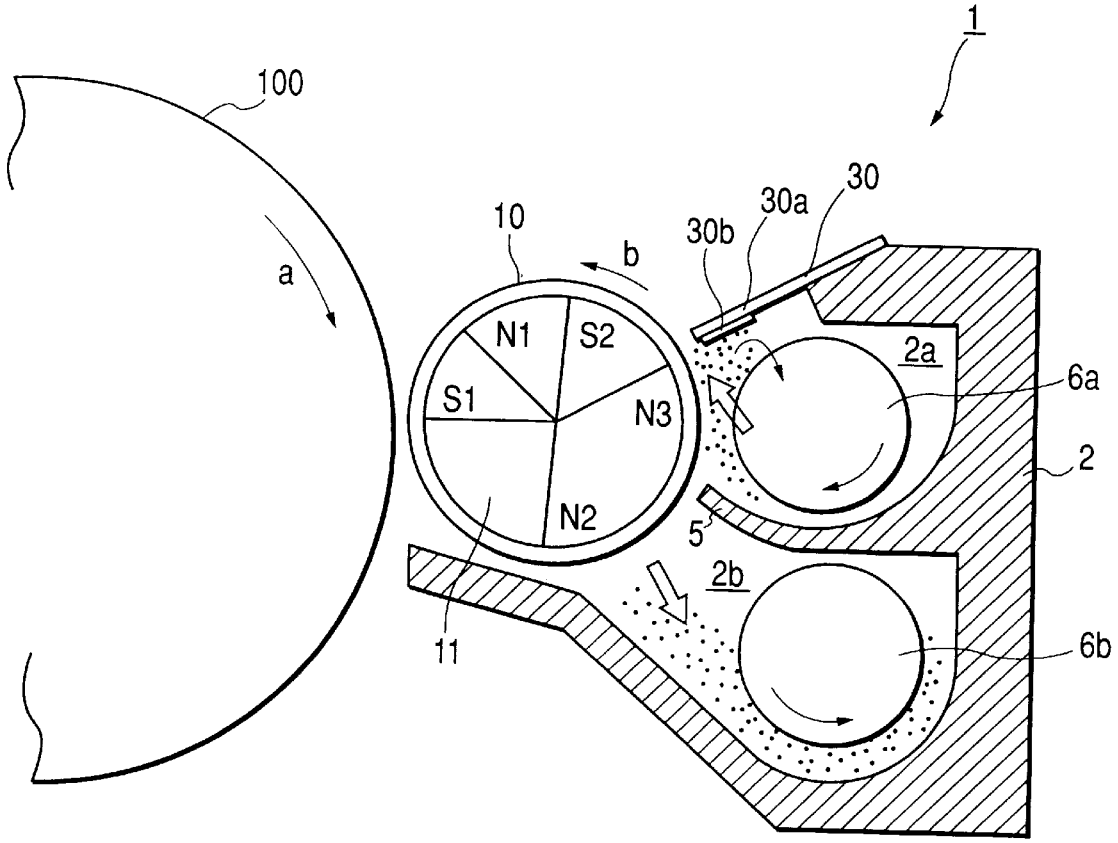
FIG. 1 is a cross-sectional view showing a developing apparatus constituting an embodiment 1 of the present invention.

Now a developing apparatus constituting a first embodiment of the present invention will be explained with reference to FIG. 1, wherein components the same as those explained in the foregoing will be represented by the same numbers as in the foregoing description.

The developing apparatus 1 of the present embodiment is provided with a developing container 2 which contains two-component developer consisting of magnetic carrier and non-magnetic resinous toner and is therein provided with a developing sleeve 10, constituting the developer bearing member, in such a manner as to oppose to a photosensitive drum 100 rotating in the direction "a". Inside the developing sleeve 10, there is provided, in unrotating manner, a magnet roller 11 constituting the magnetic field generating means and having five magnetic poles, namely a main developing pole S1 opposed to the photosensitive drum 100 and magnetic poles N2, N3, S2 and N1 arranged in the order of the rotating direction of the developing sleeve 10.

The developing container 2 is divided by a partition 5 into a first chamber 2*a* positioned above the partition 5 and a second chamber 2*b* therebelow, and developer bearing screws 6*a*, 6*b* are provided respectively in the first and second chambers 2*a*, 2*b*.

In the upper part of the first chamber 2*a* there is provided a regulating blade 30 constituting the developer regulating means in such a manner that the closest point of the blade is positioned with a distance of 600 $\mu$m to the developing sleeve 10 and with an angle of 5° at the downstream side of the pole N3 in the rotating direction of the developing sleeve 10. The regulating blade 30 is composed of a non-magnetic blade 30*a* and a magnetic plate 30*b* of a thickness of 0.3 mm adhered to a lateral face of the non-magnetic blade.

The developer in the developing container 2 is borne from the rear side of the drawing to the front side under agitation by the developer bearing screw 6*a* and is partly picked up by the pole N3 of the magnet roller 11. The pole N3 has a maximum magnetic flux density of 600 Gauss on the surface of the developing sleeve and a half value width (angle where the magnetic flux density becomes half) of 30°.

The developer thus picked up is regulated to a thickness of about 45 mg/cm$^2$ between the magnetic plate 30*b* of the regulating blade 30 and the pole N3.

When the regulating blade 30 was positioned more than 5° from the position opposed to the pole N3 at the upstream side in the rotating direction, the developer layer after thickness regulation became uneven because of the excessively low remaining amount of the developer. The unevenness in the developer layer thickness resulted when the regulating blade 30 was positioned more than 15° at the downstream side in the rotating direction because of the weak magnetic field between the pole N3 and the magnetic plate 30*b*.

More specifically, the regulating blade 30 is preferably provided within a range from a position opposed to the position of maximum magnetic flux density of the pole N3 to an angular position of x°/2 at the downstream side in the rotating direction of the developing sleeve 10, wherein x is the half value width of the pole N3.

The developer subjected to such regulation in the layer thickness is further borne through the magnetic poles S2 and N1, and develops the latent image on the photosensitive drum 100, in the vicinity of the developing pole S1. After passing the developing portion, the developer is borne to the pole N2 (having magnetic flux density for example of 400 to 500 Gauss) and drops from the developing sleeve 10 in an area where the vertical magnetic flux density Br and the horizontal magnetic flux density Bθ do not exceed 50 G. It is then borne to the rear side by the screw 6*b* positioned below the developing sleeve and is transferred, through an unrepresented aperture, to the upper screw 6*a*. (The above-mentioned vertical and horizontal magnetic fluxes need only be at least equal to 0 G in density and not be opposite to the polarity of the first and second poles).

In the present embodiment, the developer is regulated by the regulating blade 30 in the vicinity of the position opposed to the pole N3 which is positioned at the downstream side in the rotating direction of the developing sleeve 10 among the two magnetic poles N2, N3 of a same polarity, so that the superfluous developer that has not been applied onto the developing sleeve 10 and cannot be retained by the pole N3 promptly drops onto the screw 6*b*. Consequently there is not generated a large pool of the developer in the vicinity of the downstream side of the regulating blade 30 in the rotating direction of the developing sleeve 10.

Also the developer can be prevented from a high pressure resulting from the continuous supply of the developer as in the conventional art, since the developer drops and is removed between the mutually repulsive poles N2 and N3.

Consequently it is rendered possible to prevent the deterioration of the magnetic carrier and the resinous toner.

Figure 5:
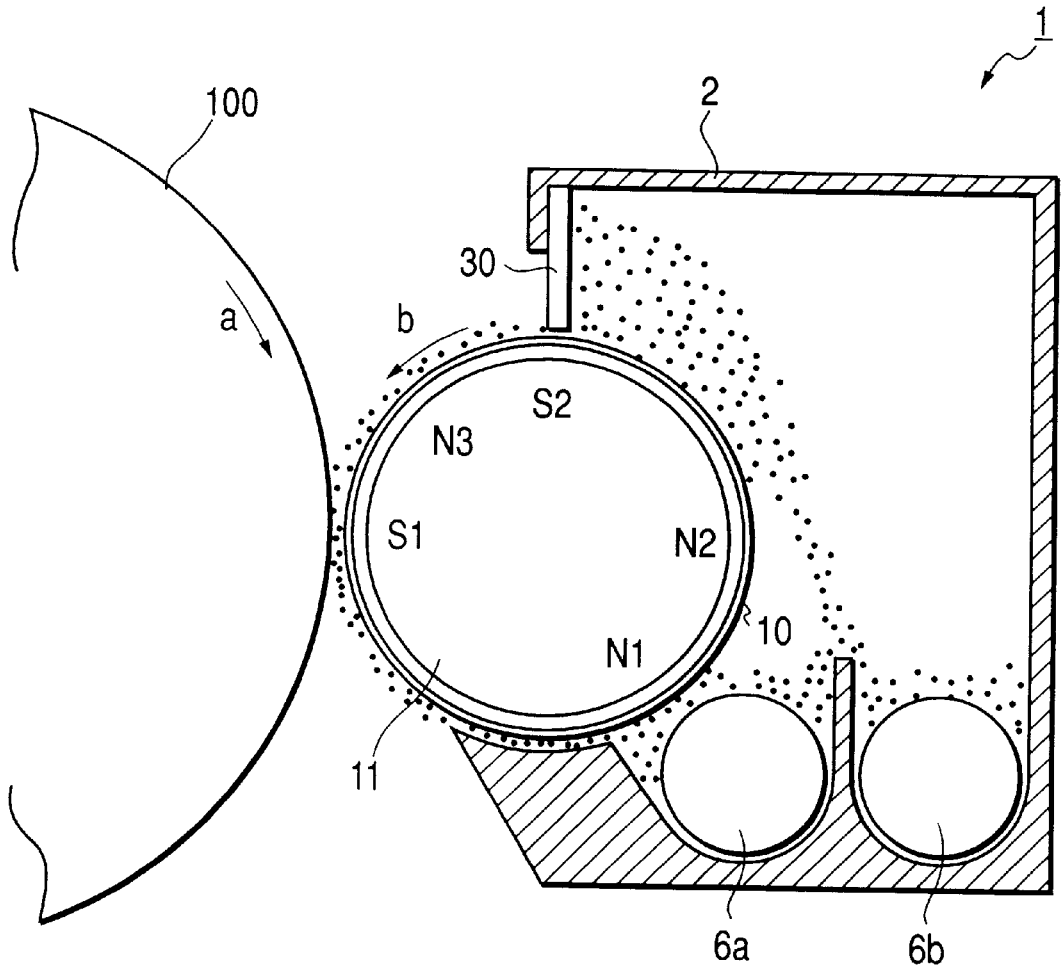
FIGS. 5 and 6 are schematic views showing examples of the conventional developing apparatus.
Figure 6:
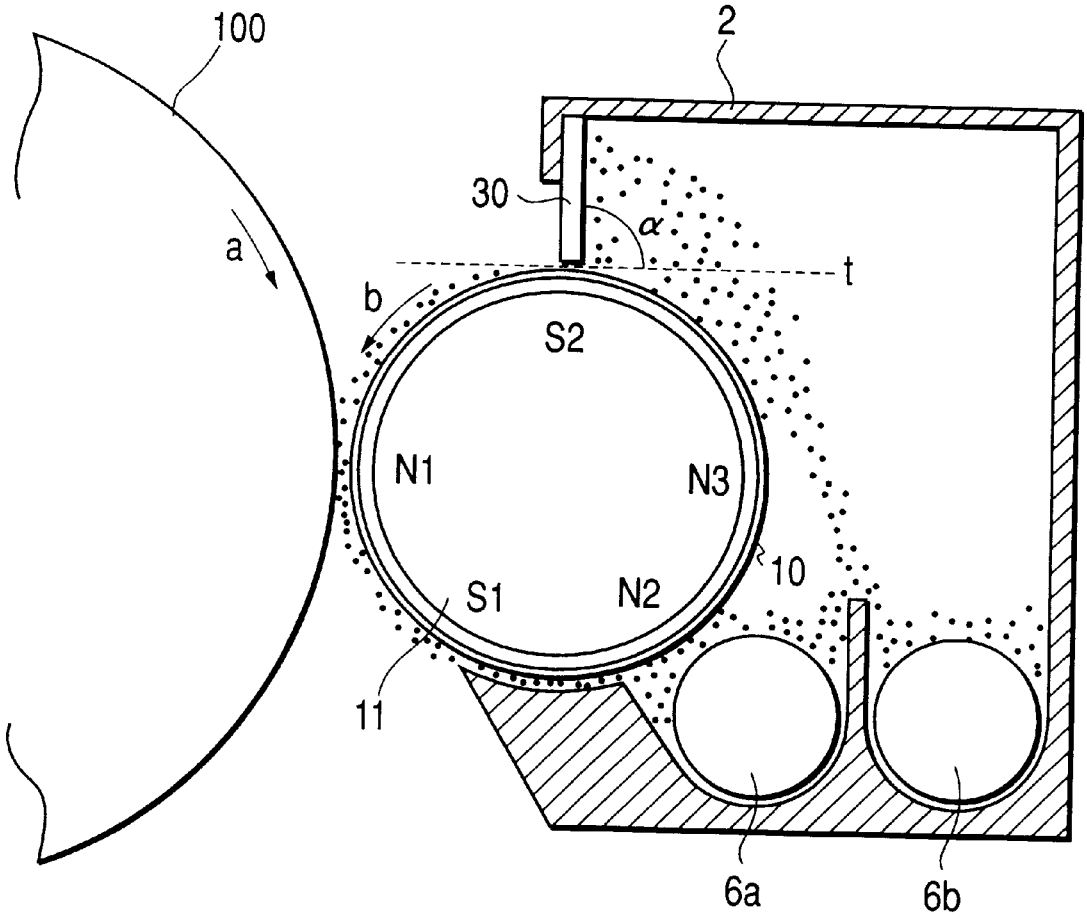

According to the experiment of the present inventors for judging the level of deterioration of the developer based on the obtained image quality as a function of the idle rotation time of the developing apparatus, in comparison with the conventional developing apparatus shown in FIG. 5, the developing apparatus of the present embodiment provided deterioration of the developer in an idle rotation time of about 5 times.

[Embodiment 2]

In the following there will be explained a second embodiment of the present invention with reference to FIG. 2.

Figure 2:
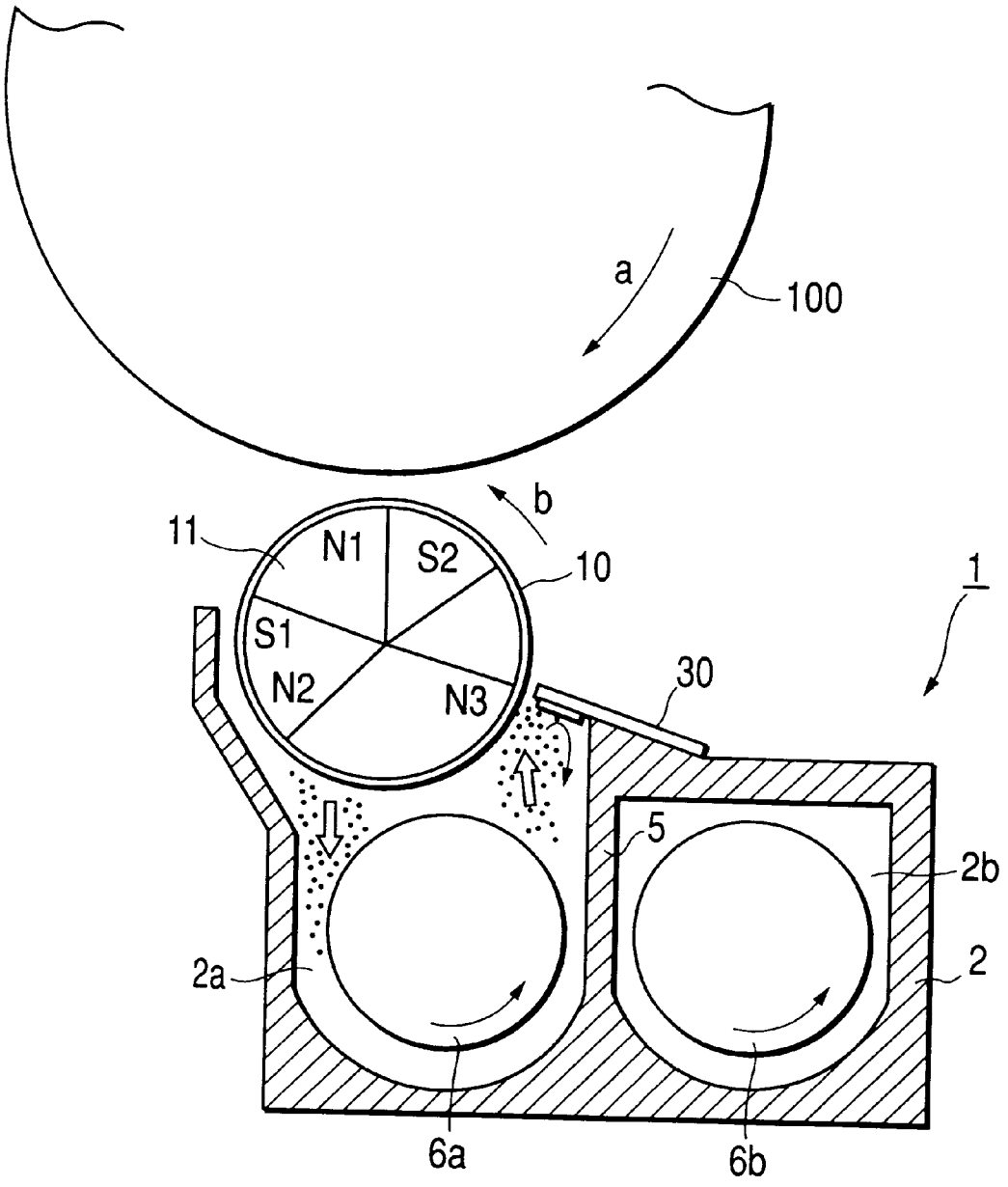
FIG. 2 is a cross-sectional view showing a developing apparatus constituting an embodiment 2 of the present invention.

As shown in FIG. 2, the developing apparatus 1 of the present embodiment executes the developing operation on the photosensitive drum 100 positioned vertically above the developing apparatus 1, and the end of the regulating blade 30 is positioned at an angular position of 60° in the rotating direction of the developing sleeve 10, 0° being defined at the vertically lowest position thereof.

The developing container 2 is horizontally divided into the partition 5 into the first chamber 2*a* and the second chamber 2*b*, respectively containing the developer bearing screws 6*a*, 6*b*.

Inside the developer sleeve 10, there is provided the non-rotating magnet roller 11 which is provided with five magnetic poles, namely the developing main pole N1 opposed to the photosensitive drum 100 and poles S1, N2, N3 and S2 in the order of the rotating direction of the developing sleeve 10.

Among the magnetic poles mentioned above, at least the poles N2, N3 are positioned within the first chamber 2*a*, while the pole N3 is substantially opposed to the regulating blade 30 explained in the foregoing first embodiment. As in the first embodiment, the regulating blade is provided within a range from a position opposed to the position of the maximum flux density of the pole N3 to an angular position of 15° at the downstream side in the rotating direction of the developing sleeve 10, wherein the half value width of the pole N3 is assumed to be 30°.

Referring to FIG. 2, the screw 6*a* bears the developer from the rear side to the front side in the drawing, and the developer dropping at the left-hand side of the screw 6*a* between the poles N2 and N3 is fixed with the developer borne by the screw 6*a* and is picked up by the pole N3 at the right-hand side of the screw 6*a*.

The developer borne to the frontmost position by the screw 6*a* is transferred to the screw 6*a* which is positioned at the right, in FIG. 2, of the screw 6*a*, and is transferred by the screw 6*b* to the rear side while being mixed with the toner replenished from an unrepresented replenishing aperture and is again transferred to the screw 6*a*.

Because of such positioning of the regulating blade 30 within a range from the vertically lowest point of the developer bearing member and an angular position of 90° in the rotating direction, the superfluous developer that has not been applied onto the developing sleeve 10 and is not retained by the pole N3 drops onto the screw 6 more easily than in the first embodiment. It is therefore rendered possible to further reduce the pressure on the developer by the pooling thereof at the upstream side of the regulating blade 30 in the rotating direction of the developing sleeve.

As explained in the foregoing, also the present embodiment allows a reduction in the pressure on the developer, resulting from the pooling thereof in the vicinity of the regulating blade.

[Embodiment 3]

Figure 3:
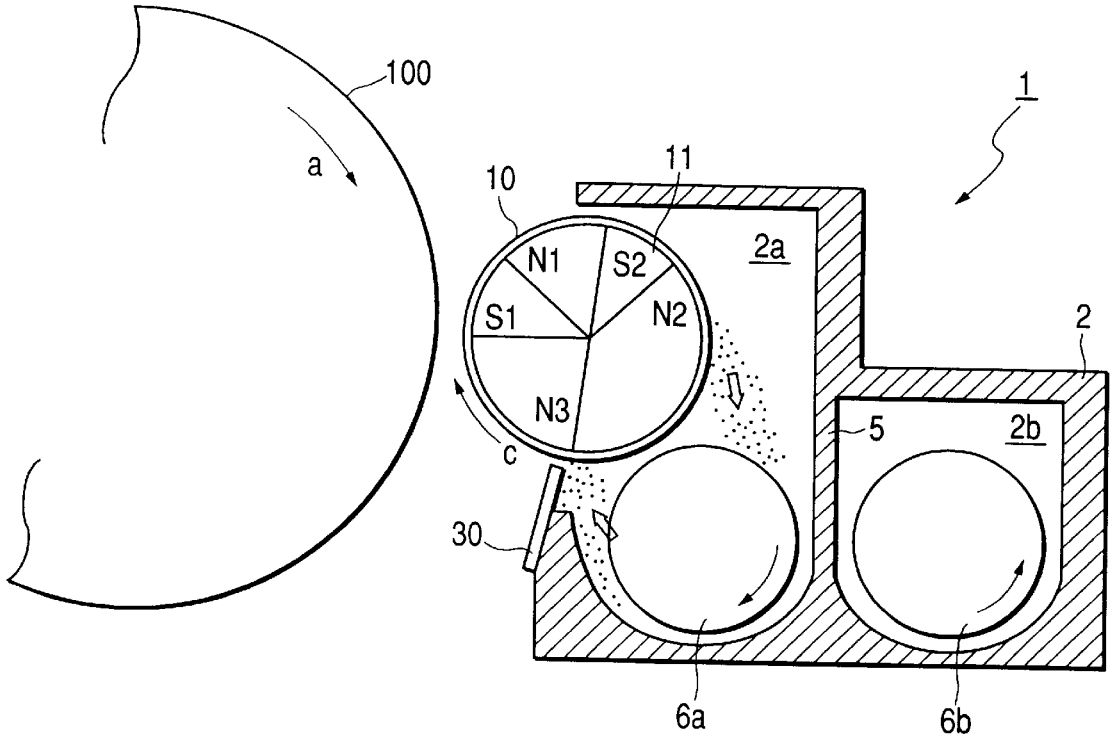
FIG. 3 is a cross-sectional view showing a developing apparatus constituting an embodiment 3 of the present invention.

In the following there will be explained a third embodiment of the present invention with reference to FIG. 3. The present embodiment discloses a developing apparatus which, as shown in FIG. 3, employs a developing sleeve 10 rotating in a counter direction, namely in a direction "c", opposite to the rotating direction a in the developing portion of the photosensitive drum 100.

In the developing apparatus 1 of the present embodiment, the magnet roller 11 is provided with five magnetic poles, namely a main developing pole S1 opposed to the photosensitive drum 100, and poles N1, S2, N2 and N3 in the rotating direction of the developing sleeve 10. The regulating blade 30 is opposed to the pole N3 at the vertically low position, under conditions substantially similar to those in the foregoing embodiments.

In the developing apparatus of such configuration, the regulating blade 30 can be positioned in the vicinity of the vertically lowest point of the developing sleeve 10, so that the developer need not be picked up from the screw 6*a* against the force of gravity and can be picked up easily even if the amount of the developer present on the screw 6*a* is regulated.

In this manner the developer can be picked up in stable manner regardless of the amount thereof in the developing container 2 whereby the unevenness in the thickness of the regulated developer layer can be reduced.

However, when the regulating blade 30 was positioned at the upstream side of the vertically lowest point of the developing sleeve 10, the pool of the developer at the upstream side of the developing sleeve 10 was pressurized by gravity, thus showing enhanced deterioration of the developer.

Consequently the regulating blade is preferably positioned within a range of 0° to 90° in the rotating direction of the developing sleeve, wherein the vertically lowest position thereof is taken as 0°.

[Embodiment 4]

Figure 7:
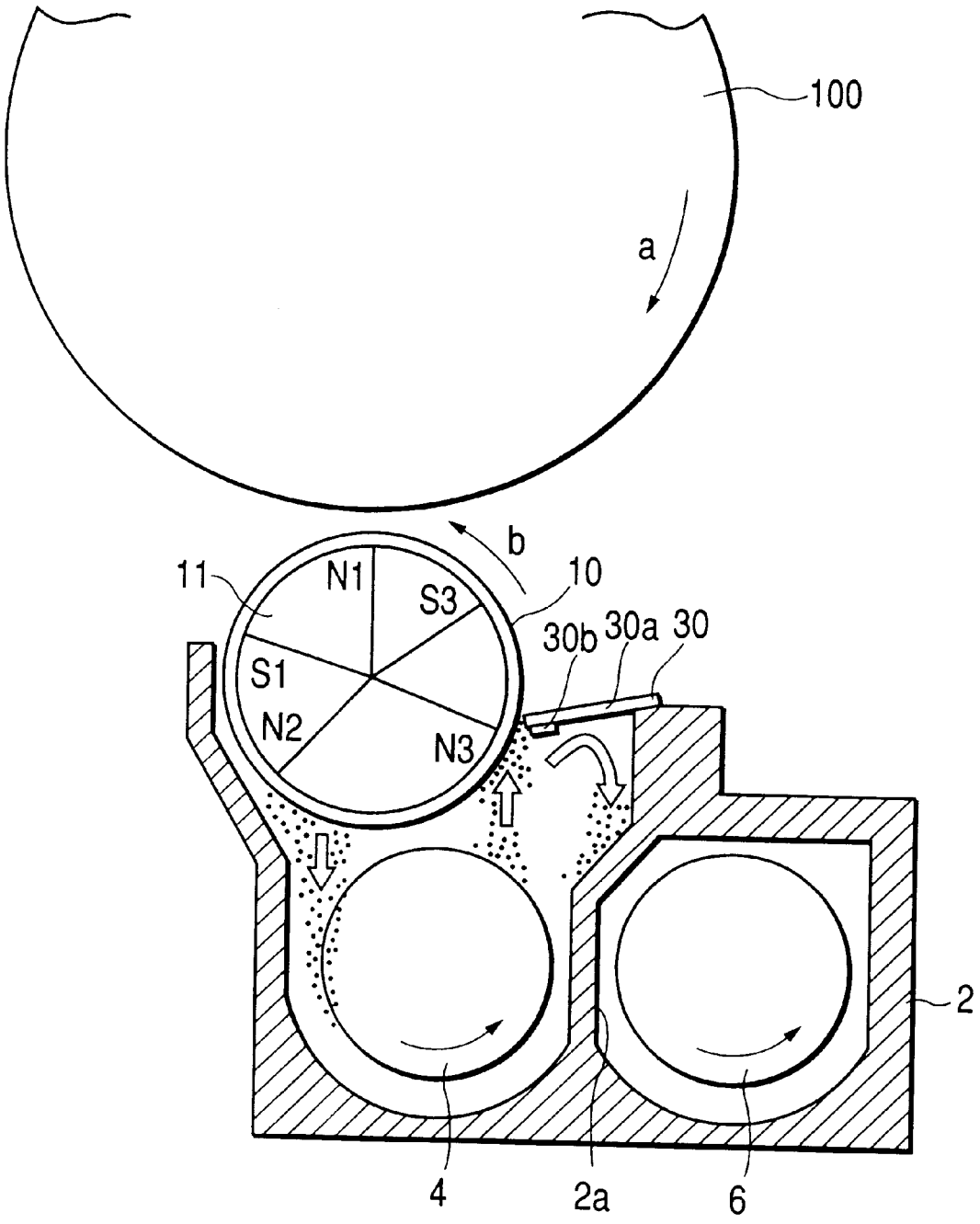
FIG. 7 is a cross-sectional view showing a developing apparatus constituting an embodiment 4 of the present invention.
Figure 8:
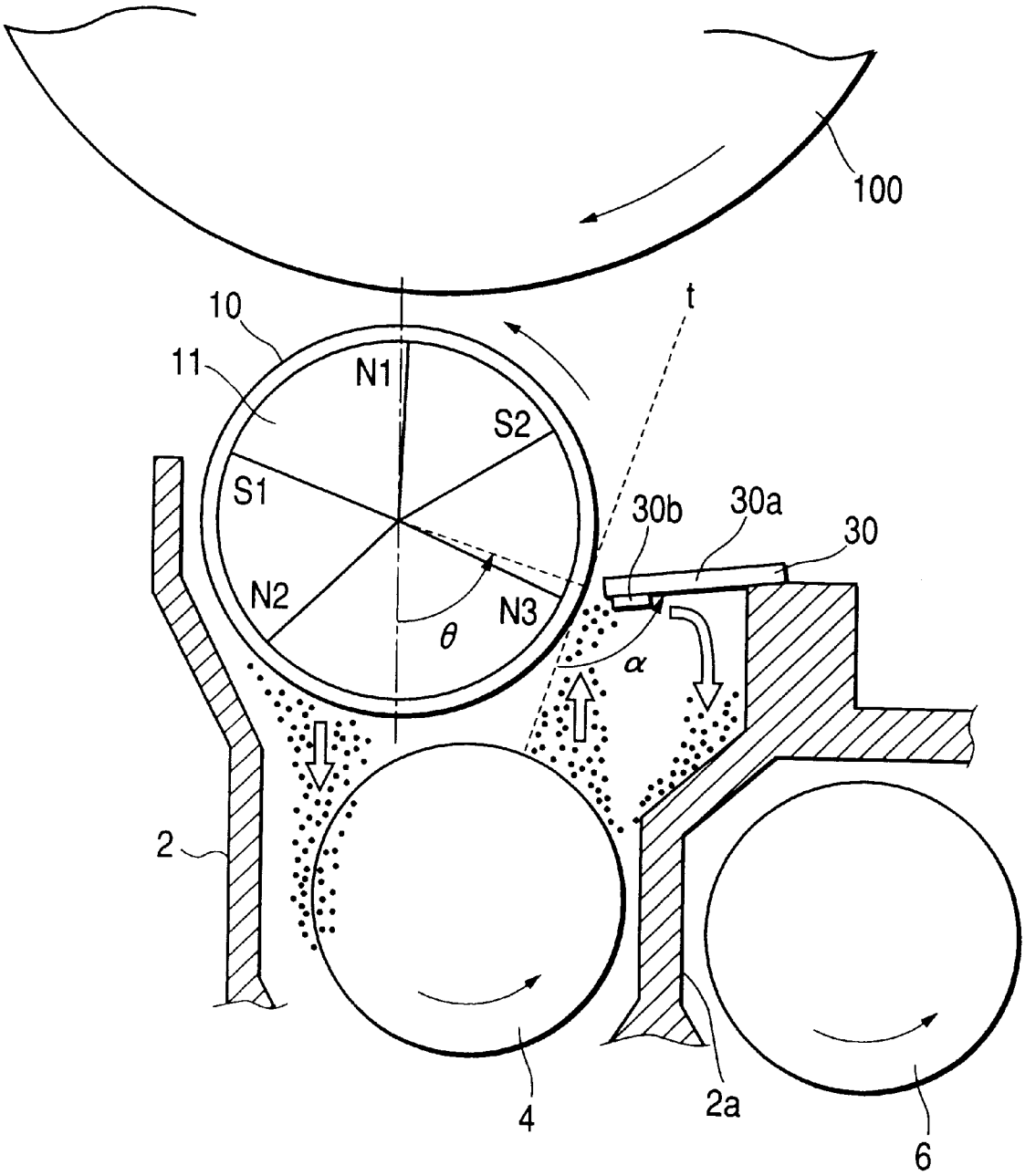
FIG. 8 is a partial, magnified view of the device shown in FIG. 7.

FIG. 7 is a cross-sectional view showing still another embodiment of the developing apparatus of the present invention, and FIG. 8 is a partial, magnified view thereof.

The present developing apparatus is provided with a developing container 2 containing two-component developer consisting of magnetic carrier and non-magnetic toner, and a developing sleeve 10 is rotatably provided at a predetermined distance from the photosensitive drum 100, at an aperture at the upper side of the container 2 opposed to the photosensitive drum 100. The developing sleeve 10 is composed of a non-magnetic cylindrical member for example of stainless steel, and is rotated in a direction "b", the same in the opposed portion as the rotating direction "b" of the photosensitive drum 100. Inside the developing sleeve 10, a magnet roller 11 constituting the magnetic field generating means is provided in non-rotating manner relative to the rotation of the developing sleeve 10.

The interior of the developing container 2 is divided into two by a partition 2*a* having unrepresented apertures on both ends in the axial direction of the developing sleeve 10, and a developer bearing screw 4 is provided in a side including the developing sleeve 10 while a developer bearing screw 6 is provided in the other side. In the upper part of the side, containing the developer bearing screw 6, of the developing container 2, namely at a part of the developing container 2 to the right of the developing sleeve 10 in FIG. 7, a regulating blade 30 is mounted in non-contact manner with the developing sleeve 10.

A magnet roller 11 is provided, on the periphery thereof, with five magnetic poles N1–N3 and S1–S2, among which the pole N1 constitutes the main developing pole and is positioned in the developing portion where the image bearing member 100 and the developing sleeve 10 are mutually opposed, while the mutually repulsive poles N2, N3 of a same polarity are provided in the developing container 2 at the downstream side of the developing portion, with respect to the rotating direction, indicated by an arrow, of the developing sleeve 10, wherein the pole N3 is positioned further downstream than the pole N2.

According to the present invention, there is formed, between the repulsive magnetic poles N2 and N3, a repulsive magnetic field having a central area in which the magnetic field Br in the vertical direction at the surface of the developing roller does not exceed 50 Gauss and the magnetic field Bθ in the horizontal direction also does not exceed 50 Gauss.

In the present embodiment, the magnetic pole N2 at the upstream side has a maximum magnetic flux density of 500 Gauss on the surface of the developing sleeve and a half value width of the magnetic flux density of 35°, while the magnetic pole N3 at the downstream side has a maximum magnetic flux density of 600 Gauss on the surface of the developing sleeve and a half value width of the magnetic flux density of 30°, thereby forming, between these magnetic poles N2 and N3, a repulsive magnetic field having a central area in which the magnetic field in the vertical direction at the surface of the developing sleeve and that in the horizontal direction do not exceed 50 Gauss.

Also the portion, closest to the developing sleeve 10, of the regulating blade 30 is positioned at a distance of 400 to 800 μm from the developing sleeve 10, in the vicinity of a position opposed to the magnetic pole N3, more specifically at the downstream side of the magnetic pole N3 in the rotating direction, within a range which does not exceed a half of the half value width X° of the magnetic pole N3 and nor an angle of 90° from the vertically lowest point of the developing sleeve 10, in the rotating direction of the developing sleeve 10.

In the present embodiment, the closest portion of the regulating blade 30 is provided at a distance of 600 μm from the developing sleeve 10 and at a position of 60° at the downstream side, in the rotating direction of the developing sleeve 10, from the vertically lowest point thereof. Also the magnetic pole N3 is provided at a position of 5° at the upstream side of the regulating blade, in the rotating direction of the developing sleeve 10.

Also the regulating blade 30 is provided, relative to the developing sleeve 10, with an angle α in the downstream side in the rotating direction of the developing sleeve (counterclockwise in FIG. 7) within a range from 90° to 180° (130° in the present embodiment) relative to the tangential direction "t" at a circumferential point of the developing sleeve 10 opposed to the closest portion of the regulating blade 30.

Furthermore, according to the present invention, in order to stabilize the thickness regulating operation of the developer layer by the regulating blade 30, the blade 30 is formed by attaching, for example by adhesion, a magnetic plate 30*b* on a face, at the upstream side in the rotating direction of the developing sleeve 10, of the end portion of a nonmagnetic blade member 30*a*. In the present embodiment, the magnetic plate 30*b* had a thickness of 0.3 mm and a width (longitudinal dimension of the cross section of the regulating blade 30 in the drawing) of 2.0 mm.

This magnetic plate 30*b* has an effect of increasing the constraining magnetic field of the magnetic pole N3 on the developer, thereby enabling to regulate the developer on the developing sleeve 10 in a predetermined thickness in stable manner. However, if the width of the magnetic plate 30*b* is larger than 2.0 mm, the magnetic field of the magnetic pole N3 exerts, beyond the regulating blade 30, on the developer which is separated from the developing sleeve 10 by the regulating operation of the regulating blade 30 and moves along the regulating blade 30, whereby it becomes no longer possible to remove the developer, moving along the regulating blade 30, therefrom by dissipating the retaining action of the constraining magnetic field on such developer. Consequently the width of the magnetic member 30*b* should not preferably exceed 2.0 mm. For a similar reason, the regulating blade 30 should not preferably be composed solely of a magnetic member. The magnetic plate 30*b* with a width smaller than 0.5 mm does not provide the effect of increasing the constraining magnetic field, so that the lower limit of the width is 0.5 mm.

According to the present invention, the two-component developer contained in the developing container 2 is borne, under agitation by the bearing screw 4, from the rear side to the front side in FIG. 7, and, in the course of such bearing operation, a part of the developer is picked up onto the developing sleeve 10 by the magnetic pole N3 of the magnet roller 11. The developer thus picked up is regulated, at an angular position of 5° at the downstream side of the magnetic pole N3, to a thickness of about 45 mg/cm$^2$ by the regulating blade 30 positioned at a distance of 600 μm from the developing sleeve 10.

The developer overflowing from the developing sleeve 10 by the regulating operation of the regulating blade 30 is pushed out from the developing sleeve 10 along the regulating blade 30, and, coming out of the reach of the magnetic field of the magnetic pole N3 and losing the retaining force thereof, it drops onto the screw 4. Consequently a large pool of the developer is not generated not only in the vicinity of the upstream side of the regulating blade 30 in the rotating direction of the developing sleeve 10 but also in the vicinity of the downstream side.

The thin layer of the developer formed by the regulating operation on the developing sleeve 10 is borne through the magnetic poles S2 and N1 by the rotation of the developing sleeve 10, and is formed into a brush shape in the developing portion by the main developing pole N1 to approach to the electrostatic latent image formed on the photosensitive drum 100, thereby developing the latent image. The developer completing the developing operation in the developing portion passes through the developing portion by the rotation of the developing sleeve 10, then borne through the magnetic poles S1 and N2 and returns to the developing container 2. In an area between the repulsive magnetic poles N2 and N3, where both the magnetic field in the vertical direction on the surface of the developing sleeve 10 and the magnetic field in the horizontal direction do not exceed 50 Gauss, the developer is peeled off from the developing sleeve 10 and drops onto the screw 4 positioned thereunder.

Consequently, according to the present invention, at the upstream side of the regulating blade 30 in the rotating direction of the developing sleeve, there only exists the developer retained by the magnetic pole N3 so that there is not created a large pool of the developer as in the conventional art. Also at the downstream side of the regulating blade 30, the developer is in motion so that a large pressure is not created therein. Consequently, even after prolonged use, there can be significantly prevented the deterioration of the magnetic carrier and the non-magnetic toner in the developer.

The developer dropping onto the screw 4, together with the overflowing developer in the regulating operation, is borne by the screw 4 toward the front side, in FIG. 7, of the developing container 2, then transferred to the screw 6 through the aperture of the partition 2*a*, further borne by the screw 6 toward the rear side of the developing container 2, and is mixed in the course of such bearing with the toner replenished from an unrepresented toner replenishing tank. The developer borne to the rear side of the developing container 2 is transferred to the screw 4 through the other aperture of the partition 2*a* and is used cyclically.

In the present invention, the deterioration of the developer was evaluated from the obtained image quality in relation to the working time of the developing apparatus. As a result, the developing apparatus of the present invention showed very little deterioration of the developer, and, in comparison with the conventional developing apparatus shown in FIG. 5, the deterioration of a same level was observed only after a working time of about 7 times.

Figure 9:
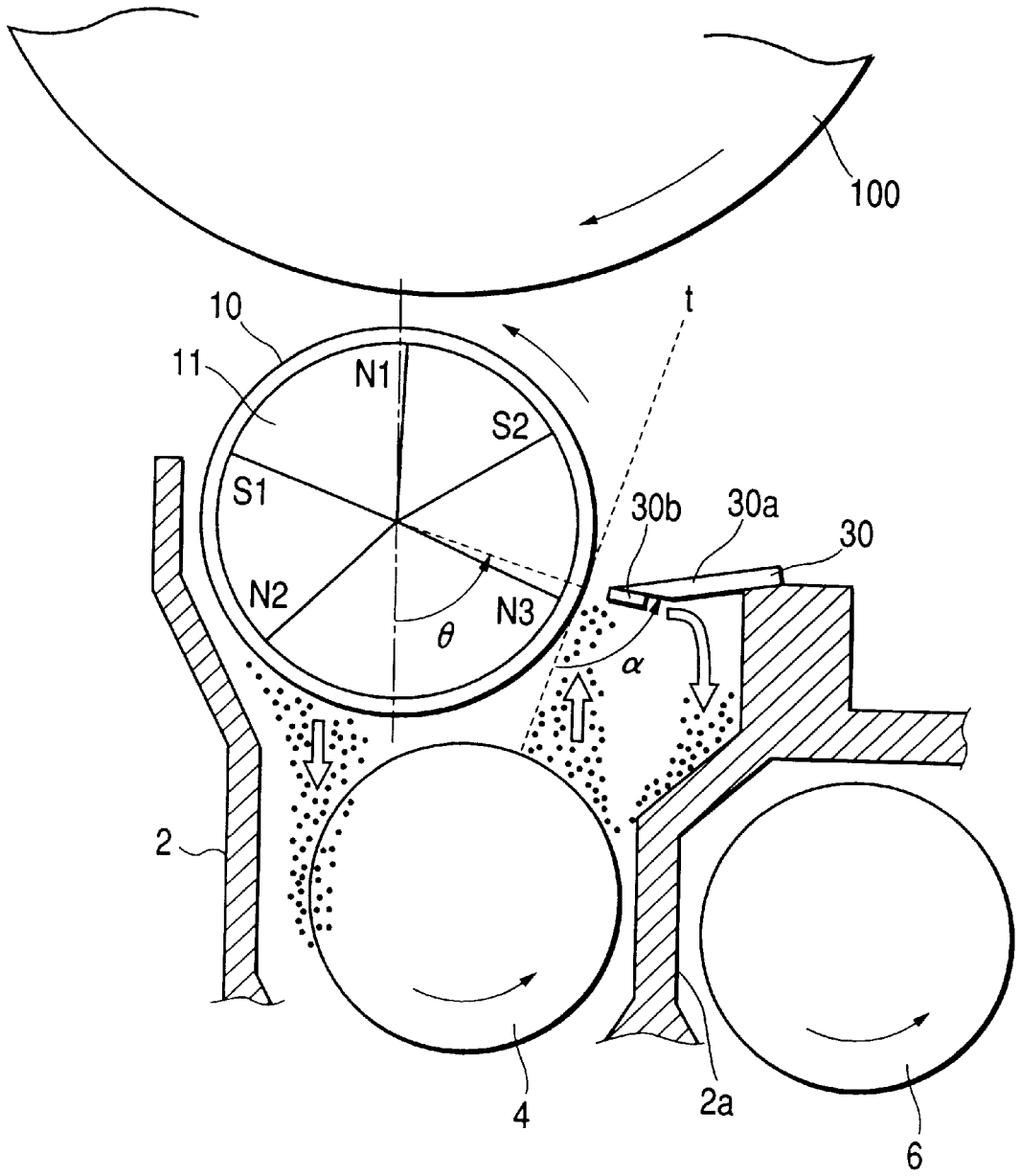
FIG. 9 is a cross-sectional view showing another embodiment of the developing apparatus of the present invention.

In the foregoing description, the blade member 30*a* of the regulating blade 30 is assumed to have a same thickness over the longitudinal cross section thereof, but the blade member 30*a* may also be formed gradually thinner toward the end portion as shown in FIG. 9. Such configuration allows to prevent the stay of the developer at the front end portion of the regulating blade 30, thereby avoiding generation of unnecessary pressure, whereby the effect of the present invention for reducing deterioration of the developer can be further enhanced.

The present invention has been explained by the preferred embodiments thereof, but the present invention is by no means regulated by such embodiments and is subject to any and all modifications within the scope and spirit of the appended claims.

What is claimed is:

1. A developing apparatus comprising:

a developer bearing member opposed to an image bearing member to form a developing portion therebetween and adapted to rotate while bearing magnetic developer;

a first magnetic pole and a second magnetic pole of a same polarity as that of said first magnetic pole, adjacent at the downstream side of said first magnetic pole with respect to the rotating direction of said developer bearing member, both provided in said developer bearing member; and a regulating member for regulating the amount of a developer on said developer bearing member;

wherein a regulating portion of said regulating member is provided within a range from a point of a maximum magnetic flux density of said second magnetic pole to an angular point corresponding to a half of a half value width of said second magnetic pole at the downstream side of said point of the maximum magnetic flux density in the rotating direction of said developer bearing member.

2. A developing apparatus according to claim 1, wherein said developer bearing member bears a toner and a carrier as the magnetic developer.

3. A developing apparatus according to claim 1, wherein, between said first and second magnetic poles, there is formed an area in which the magnetic flux density does not exceed 50 Gauss both in the normal direction to the surface of said developer bearing member and in the tangential direction thereto.

4. A developing apparatus according to claim 1, wherein the regulating portion is provided within a range from the vertically lowest point of said developer bearing member to an angular position of 90° at the downstream side in the rotating direction of said developer bearing member.

5. A developing apparatus according to claim 4, wherein said regulating member is so provided as not to contact said developer bearing member.

6. A developing apparatus according to claim 5, wherein said regulating member includes a regulating plate which is so positioned that the downward angle with respect to the tangential line to said developer bearing member is within a range from 90° to 180°.

7. A developing apparatus according to claim 5, wherein said regulating member includes a non-magnetic plate and a magnetic member provided at the end portion of said non-magnetic plate.

8. A developing apparatus according to claim 7, wherein said non-magnetic plate has a gradually decreasing thickness toward the end portion thereof.

* * * * *

UNITED STATES PATENT AND TRADEMARK OFFICE

CERTIFICATE OF CORRECTION

PATENT NO. : 6,067,433

DATED : May 23, 2000

INVENTOR(S) : SHIGEO KIMURA, ET AL.

It is certified that error appears in the above-identified patent and that said Letters Patent is hereby corrected as shown below:

COLUMN 2
Line 12, "a," should read --α,--.

COLUMN 3
Line 29, "a" should read --"a"--.

COLUMN 6
Line 51, "non-rotating" should read --nonrotating--; and
Line 63, "non-contact" should read --noncontact--.

COLUMN 7
Line 34, "and" should be deleted.

COLUMN 8
Line 34, "not" (first occurrence) should be deleted.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*